US011022402B1

(12) United States Patent
Scott et al.

(10) Patent No.: US 11,022,402 B1
(45) Date of Patent: Jun. 1, 2021

(54) PRINTING-REDUCING STRAP FOR USE WITH CONCEALED CARRY HOLSTERS

(71) Applicants: Brandon R. Scott, American Fork, UT (US); Daenen Scott, Saratoga Springs, UT (US)

(72) Inventors: Brandon R. Scott, American Fork, UT (US); Daenen Scott, Saratoga Springs, UT (US)

(73) Assignee: Brave Response Shooting, LLC, Highland, UT (US)

( * ) Notice: Subject to any disclaimer, the term of this patent is extended or adjusted under 35 U.S.C. 154(b) by 0 days.

(21) Appl. No.: 16/199,176

(22) Filed: Nov. 24, 2018

(51) Int. Cl.
*F41C 33/04* (2006.01)

(52) U.S. Cl.
CPC ..... *F41C 33/046* (2013.01); *F41C 33/041* (2013.01); *F41C 33/048* (2013.01)

(58) Field of Classification Search
CPC ..... F41C 33/041; F41C 33/046; F41C 33/048
USPC ..... 224/901.4
See application file for complete search history.

(56) References Cited

U.S. PATENT DOCUMENTS 3,942,692 A * 3/1976 Chica ..... F41C 33/0227 224/243
4,544,089 A * 10/1985 Tabler ..... F41C 33/0236 224/192
5,636,868 A * 6/1997 Ross, Jr. ..... B42D 3/18 116/234
2016/0265875 A1* 9/2016 Malcolm ..... F41C 33/048

* cited by examiner

*Primary Examiner* — Corey N Skurdal
(74) *Attorney, Agent, or Firm* — Dentons Durham Jones Pinegar

(57) ABSTRACT

A printing-reducing strap configured for use with a concealed carry holster is capable of interacting with the concealed carry holster in a manner that reduces printing of a handgun carried by the concealed carry holster by pulling the handgun into the body of an individual who wears the concealed carry holster. The printing-reducing strap includes a first end capable of being secured to a holster body of the concealed carry holster and a second end capable of being secured to a portion of a waistband of the concealed carry holster located adjacent to a handgun receptacle of the holster body. Concealed carry holsters that include printing-reducing straps and methods for reducing printing by handguns carried by concealed carry waist holsters are also disclosed.

20 Claims, 5 Drawing Sheets

PRINTING-REDUCING STRAP FOR USE WITH CONCEALED CARRY HOLSTERS

TECHNICAL FIELD

This disclosure relates generally to concealed carry holsters for handguns and, more specifically, to straps that can be used with a concealed carry holster in a manner that pulls a handgun into a wearer's body to reduce the distance the handgun and holster protrude from the wearer's body. Concealed carry holsters that include such straps are also disclosed, as are methods for wearing concealed carry holsters.

RELATED ART

Concealed carry holsters are typically designed to enable a wearer to secure a handgun to his or her body in a manner that enables the wearer to readily access the handgun while hiding the handgun, or concealing it from view. Concealed carry holsters are often made to arrange a handgun and any associated hardware (e.g., magazines, cartridges, etc.) on the wearer's body with a minimal profile to reduce the potential visibility of the handgun and any associated hardware beneath the wearer's clothes, or the "printing" of these items onto the wearer's clothes.

A variety of concealed carry holsters are configured to be worn around an individual's waist, beneath the waistband of his or her pants, shorts, skirt, or other lower body covering, or "bottoms." These types of concealed carry holsters have also been referred to as a "concealed carry waist holster" or as a "CCW holster." Such a concealed carry holster typically includes a waistband that is made to extend completely around the wearer's waist and to securely fasten a holster body in place adjacent to the wearer's lower abdomen and or hip. The waistband of such a concealed carry holster is typically designed for comfort. The holster body of such a concealed carry holster, including the handgun receptacle and any pockets of the holster body, is often designed to receive a handgun and, optionally, additional cartridges, magazines, or other hardware in a manner that minimizes protrusion of the body of the concealed carry holster, the handgun carried by the handgun receptacle of the concealed carry holster, and any other hardware carried by the concealed carry holster and, thus, printing of these items onto the wearer's clothes.

Conventionally, concealed carry holsters with waistbands that extend around a wearer's waist hold a handgun and any other hardware against the wearer's body while pushing the wearer's waistband away from his or her body. While concealed carry holsters with such conventional designs provide the overall effect of minimizing protrusion of the hardware and, thus, printing of the hardware onto the wearer's clothes, they can have a tendency to indiscriminately tighten the waistband of his or her pants and indiscriminately force the hardware against his or her body, including the lower abdomen and/or hips, which may create uncomfortable—even painful—pressure points against the wearer's body.

SUMMARY

A strap according to this disclosure is capable of adjusting a concealed carry holster to control the manner in which a handgun and, optionally, other hardware (e.g., one or more magazines, etc.) is forced toward, or pulled into, a wearer's body. Thus, the strap may enable the wearer to reduce printing of the concealed carry holster and the hardware it carries while maximizing comfort. Accordingly, a strap according to this disclosure may be referred to as a "printing-reducing strap."

In various embodiments, a printing-reducing strap may have a configuration that enables it to extend laterally or rearwardly along a concealed carry holster, from a handgun receptacle of a holster body of the concealed carry holster to a portion of a waistband adjacent to (e.g., lateral to, to the rear of, etc.) the handgun receptacle. The printing-reducing strap may extend between the handgun receptacle and the adjacent portion of the waistband in any of a variety of different arrangements, which may enable a wearer to adjust and tailor the extent to which (i.e., the force with which) a handgun in the handgun receptacle, along with any other hardware carried by the holster body, is pulled into his or her body, as well as the angle at which the handgun and any other hardware is pulled relative to the waistband of the concealed carry holster.

A printing-reducing strap may include an elongated element including a body with opposite first and second ends. A first end of the printing-reducing strap or, more specifically, a first holster-engaging feature of the first end of the printing-reducing strap is capable of engaging an exterior of a handgun receptacle or another feature of a holster body of a concealed carry holster. Thus, the first end of the printing-reducing strap may be referred to as a "holster body-engaging end" of the printing-reducing strap. In some embodiments, the holster body-engaging end of the printing-reducing strap can engage the handgun receptacle at any of a variety of locations on the holster body. The holster body-engaging end of the printing-reducing strap may have a configuration that enables it to orient the body of the printing-reducing strap in a variety of different orientations relative to the handgun receptacle and/or the holster body of which the handgun receptacle is a part.

A second end of the printing-reducing strap may be capable of engaging a waistband of the concealed carry holster and may, therefore, be referred to as a "waistband-engaging end" of the printing-reducing strap. The waistband-engaging end of the printing-reducing strap or, more specifically, a second holster-engaging feature of the waistband engaging end of the printing-reducing strap may be capable of engaging a portion of the waistband adjacent to (e.g., lateral to, to the rear of, etc.) the handgun receptacle of the holster body of the concealed carry holster at any of a variety of locations along a length of that portion of the waistband. The holster body-engaging end of the printing-reducing strap may have a configuration that enables it to orient the body of the printing-reducing strap in a variety of different orientations relative to the portion of the waistband to which the holster body-engaging end is secured.

In some embodiments, a body of the printing-reducing strap may be capable of storing one or more items. Without limitation, the body of the print-reducing strap may include a pair of superimposed elements that are secured together at the holster body-engaging end and the waistband-engaging end, but that may be moved apart from one another at one or more locations between the holster body-engaging end and the waistband-engaging end. Such an arrangement may enable the body of the print-reducing strap to receive and/or to be engaged by one or more items.

In some embodiments, a printing-reducing strap may comprise the elongated body, the first holster-engaging feature of the holster body-engaging end (i.e., the first end) of the elongated body, and the second holster-engaging feature of the waistband-engaging end (i.e., the second end) of the elongated body, as well as any of a variety of other features. In other embodiments, a printing-reducing strap may consist essentially of the elongated body, the first holster-engaging feature, and the second holster-engaging feature, with other feature being non-essential. In still other embodiments, a printing-reducing strap may consist of the elongated body, the first holster-engaging feature, and the second holster-engaging feature.

Another aspect of this disclosure includes strap-engaging features that enable a printing-reducing strap to be arranged relative to and secured between a handgun receptacle of a holster body of a concealed carry holster and a waistband of the concealed carry holster. A first strap-engaging feature may be positioned on the handgun receptacle and be capable of engaging and/or being engaged by the holster body-engaging end of the printing-reducing strap in a manner that enables the holster body-engaging end to be oriented and secured in place relative to the handgun receptacle. The first strap-engaging feature may be secured to the handgun receptacle or it may comprise part of the handgun receptacle.

A second strap-engaging feature may be positioned on a portion of the waistband of the concealed carry holster at a location adjacent to (e.g., lateral to, to the rear of, etc.) the handgun receptacle of the holster body of the concealed carry holster. The second strap-engaging feature may be capable of engaging and/or being engaged by the waistband-engaging end of the printing reducing strap in a manner that enables the waistband-engaging end of the printing-reducing strap to be oriented and secured in place relative to the waistband of the concealed carry holster. The second strap-engaging feature may be secured to the waistband or comprise part of the waistband.

Embodiments of concealed carry holsters that include printing-reducing straps and complementary first and second strap-engaging features are also within the scope of this disclosure.

A method for concealed carrying of handgun may include tailoring the manner in which a concealed carry holster pulls a handgun into a wearer's body. Such a method includes pulling a handgun receptacle of a holster body of a concealed carry holster and a handgun therein in a direction and to an extent into the wearer's body that will comfortably reduce printing of the handgun onto the wearer's clothing; i.e., reducing printing without creating pressure points that are painful to or otherwise uncomfortable for the wearer. In various embodiments, a printing-reducing strap may be oriented and secured between the handgun receptacle and the waistband of the concealed carry holster, with an angle of the printing-reducing strap relative to the waistband defining the direction the handgun receptacle and the handgun are pulled into the wearer's body, as well as part(s) of the handgun that is (are) pulled into the wearer's body and the location(s) of the wearer's body into which that (those) part(s) of the handgun is (are) pulled. The amount of tension in the printing-reducing strap may define the extent to which, or the force with which, the handgun is pulled into the wearer's body and, thus, the pressure applied to the location(s) of the wearer's body into which one or more parts of the handgun are pulled. If uncomfortable pressure points develop, the orientation of the printing-reducing strap relative to the handgun receptacle and the waistband and/or the tension in the printing-reducing strap may be adjusted to provide further comfort.

Notably, a printing-reducing strap according to this disclosure may be used with a concealed carry holster in a manner that comfortably reduces printing while also reducing the force applied outwardly by the concealed carry holster, the handgun, and/or any additional hardware on the waistband of the wearer's pants, shorts, skirt, or other lower body covering, or bottoms. By reducing the outward force on the waistband of the wearer's clothes, the potential pressure points caused by the waistband around the wearer's waist may also be reduced.

Other aspects of the disclosed subject matter, as well as features and advantages of various aspects of the disclosed subject matter, should become apparent to those of ordinary skill in the art through consideration of the preceding summary, the foregoing description, the accompanying drawings, and the appended claims.

DETAILED DESCRIPTION

Figure 1:
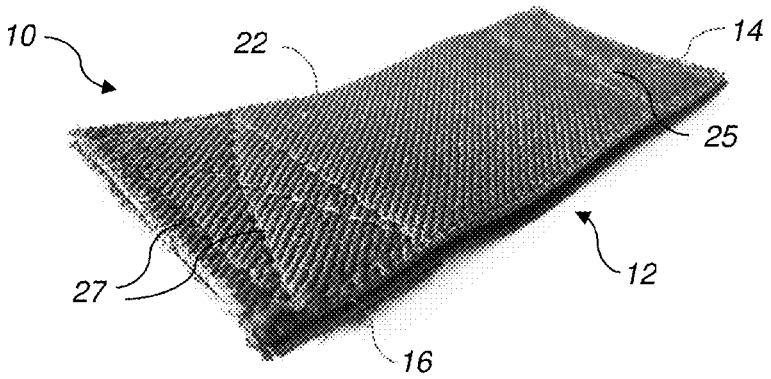
FIG. 1 is an orthogonal view of an embodiment of a printing-reducing strap according to this disclosure.

FIGS. 1-6 illustrate an embodiment of a printing-reducing strap 10 that may be used with various embodiments of concealed carry holsters (not shown in FIGS. 1-6). The printing-reducing strap 10 may be used with embodiments of concealed carry holsters that include waistbands (not shown in FIGS. 1-6). A concealed carry holster with a waistband may be capable of positioning and securing a holster body (not shown in FIGS. 1-6) and, thus, a handgun (not shown in FIGS. 1-6) at a desired location around a wearer's waist (e.g., in front of his or her lower abdomen and/or hip, adjacent to his or her hip, etc.), beneath the wearer's clothes.

As illustrated by FIGS. 1-6, a printing-reducing strap 10 may include an elongated body 12, a first end 14 and a second end 16, with the first end 14 and the second end 16 comprising opposite ends of the elongated body 12. The elongated body 12 may define an outwardly facing surface of the printing-reducing strap 10; i.e., a surface of the printing-reducing strap 10 that is to be oriented away from the concealed carry holster and the wearer of a concealed carry holster, as well an inwardly facing surface of the printing-reducing strap 10; i.e., a surface of the printing-reducing strap 10 that is to be oriented toward the concealed carry holster and the wearer of the concealed carry holster.

The outwardly facing surface of the printing-reducing strap 10 may be referred to as a front surface 22 of the printing-reducing strap 10. The inwardly facing surface of the printing-reducing strap 10 may be referred to as a rear surface 32 of the printing-reducing strap 10. In addition to the elongated body 12, the printing-reducing strap 10 includes a first holster-engaging feature 44 and a second holster-engaging feature 46.

The elongated body 12 of the printing-reducing strap 10 may be formed from an elastic material. Without limitation, the elongated body 12 may comprise a webbing formed from a woven elastic fabric (e.g., a blend of cotton and/or polyester with spandex or elastane, etc.). The elongated body 12 may comprise a single member. Alternatively, the elongated body 12 may comprise two or more superimposed members, such as the outer member 20 and the inner member 30 shown in FIG. 5. An outwardly facing surface of the outer member 20 may comprise the front surface 22 of the printing-reducing strap. An outwardly facing surface of the inner member 30 may comprise the rear surface 32 of the printing-reducing strap 10.

Figure 2:
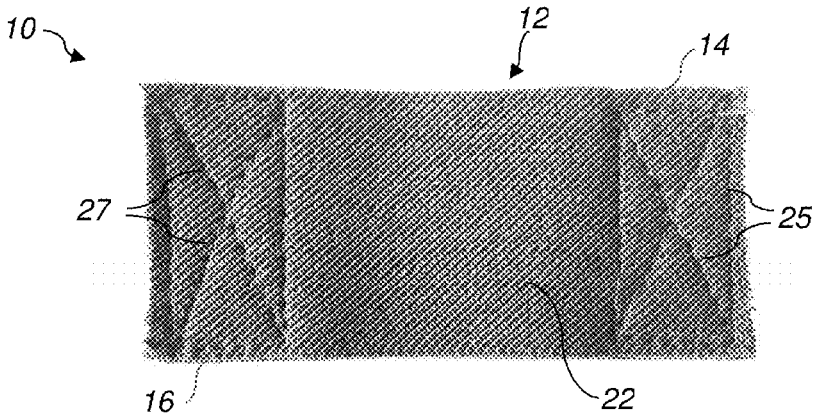
FIG. 2 is a front view of the printing-reducing strap shown in FIG. 1.
Figure 3:
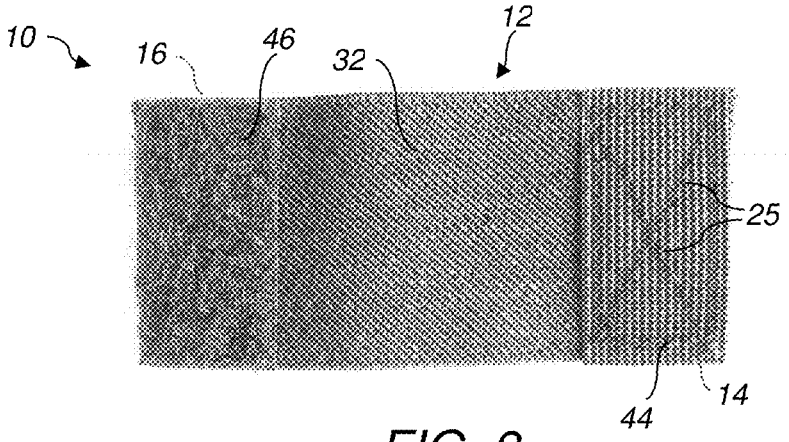
FIG. 3 is a rear view of the printing-reducing strap shown in FIG. 1.
Figure 4:
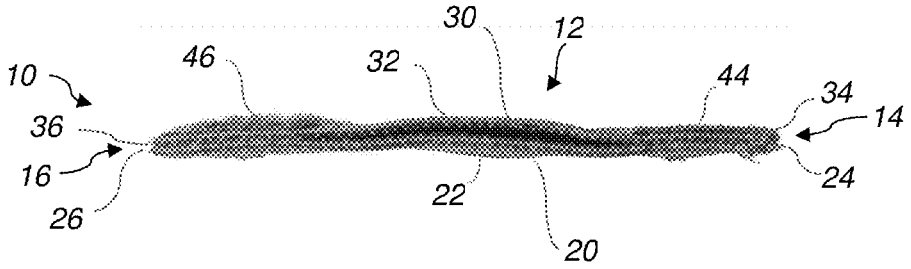
FIG. 4 is a top edge view of the printing-reducing strap shown in FIG. 1.
Figure 5:
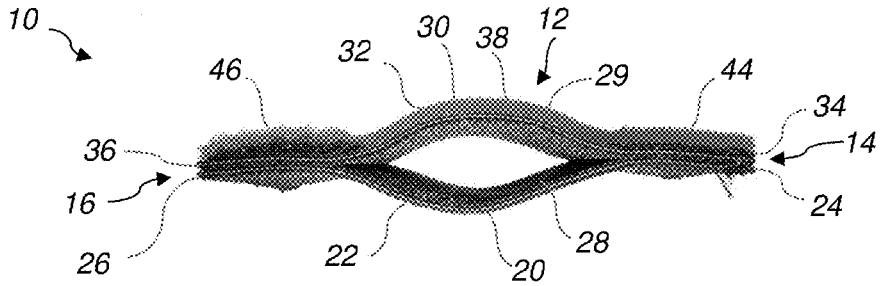
FIG. 5 is a top edge view showing a body of the printing-reducing strap in a somewhat open arrangement.
Figure 6:
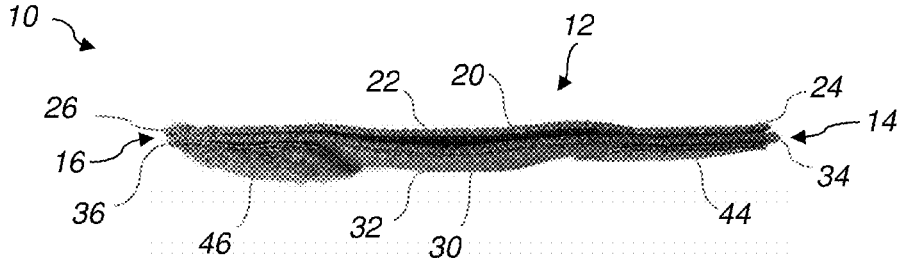
FIG. 6 is a bottom edge view of the printing-reducing strap of FIG. 1.

In the specific, but nonlimiting, embodiment of elongated body 12 depicted by FIG. 5, a first end 24 of the outer member 20 of the elongated body 12 and a first end 34 of the inner member 30 of the elongated body 12 may be secured together to define the first end 14 of the printing-reducing strap 10. As an example, the first end 24 of the outer member 20 and the first end 34 of the inner member 30 may be held together by way of stitching 25, such as that shown in FIG. 2. Likewise, a second end 26 of the outer member 20 and a second end 36 of the inner member 30 may be secured together to define the second end 16 of the printing-reducing strap 10. By way of example, the second end 26 of the outer member 20 and the second end 36 of the inner member 30 may be secured to each other with stitching 27, as illustrated by FIG. 2. Alternatively, other suitable techniques, such as adhesive materials, thermal bonding techniques, and mechanical fasteners (rivets, buttons/button holes, etc.), may be used to secure corresponding ends of the outer member 20 and the inner member 30 together.

While corresponding ends of the outer member 20 and the inner member 30 of the elongated body 12 may be secured to each other, one or more intermediate locations 28 and 38 of the outer member 20 and the inner member 30, respectively, may remain at least partially unsecured, enabling the outer member 20 and the inner member 30 to be at least partially spaced apart, or moved apart from one another, at these locations. Thus, one or more receptacles 29 may be defined between the intermediate locations 28 of the outer member 20 and the intermediate locations 38 of the inner member 30 of the elongated body 12 of the printing-reducing strap 10. Each receptacle 29 may comprise a pass-through with two open ends, as shown in FIG. 5, or a close-ended pocket. Thus, each receptacle 29 may be capable of receiving one or more items and/or engaging or being engaged by one or more items.

The elongated body 12 may have any suitable dimensions, provided that a length of the elongated body 12 enables it to be secured to a holster body (e.g., a handgun receptacle of a holster body, etc.) (not shown in FIGS. 1-6), traverse a boundary between the holster body and a waistband of a concealed carry holster (not shown in FIGS. 1-6), and be secured to the waistband. Such a length may be about 3 inches or greater (e.g., a length of about 4 inches, about 5 inches, about 6 inches, any length of up to 12 inches, etc.). In a specific embodiment, the elongated body may have a length of about 4 inches (e.g., 4¼ inches, 4½ inches, etc.) and a height of about 2 inches.

As shown in FIGS. 3-6, the first holster-engaging feature 44 and the second holster-engaging feature 46 of the printing reducing strap 10 may be accessible from (e.g., secured to, etc.) the rear surface 32 of the printing-reducing strap 10, with the first holster-engaging feature 44 at the first end 14 of the printing-reducing strap 10 and the second holster-engaging feature 46 at the second end 16 of the printing-reducing strap 10. In a specific embodiment, each of the first holster-engaging feature 44 and the second holster-engaging feature 46 may comprise a fastener of a known type, such as a member of a hook and loop type fastener (e.g., a member of a VELCRO® hook and loop fastener, etc.), a member of a hook and hook type fastener (e.g., a member of a VELCRO® hook and hook fastener, etc.), or the like. Even more specifically, as depicted, the first holster-engaging feature 44 may comprise the hooks side of a hook and loop type fastener and the second holster-engaging feature 46 may comprise the loops side of a hook and loop type fastener.

Figure 7:
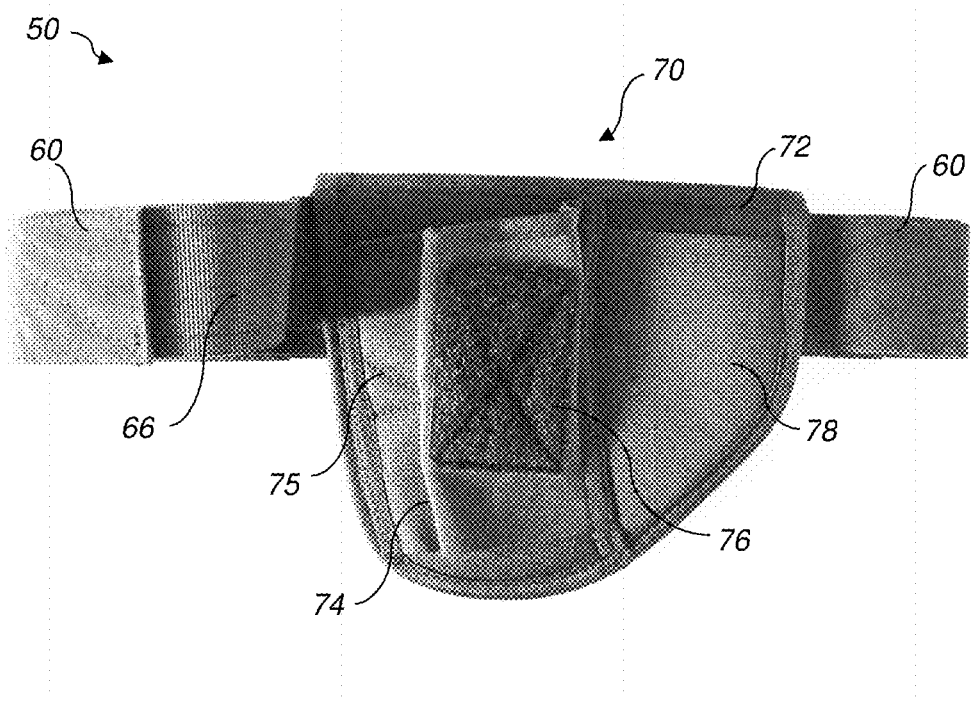
FIG. 7 illustrates an embodiment of a concealed carry holster capable of use with a printing-reducing strap of this disclosure.

Turning now to FIG. 7, an embodiment of a concealed carry holster 50 is depicted. The concealed carry holster 50 is capable of use with a printing-reducing strap 10 according to this disclosure. As illustrated, the concealed carry holster 50 comprises a CCW holster with a waistband 60 and a holster body 70. More specifically, the concealed carry holster 50 depicted by FIG. 7 is a so-called appendix holster, which is configured to be carried over a wearer's lower abdomen (e.g., at a location from about 10:00 to about 2:00).

The waistband 60 of the concealed carry holster 50 is capable of being worn around an individual's waist, and may be worn comfortably over his or her undergarments or next to his or her skin. The waistband 60 may be adjustable. The waistband 60 may be at least partially elastic; it may comprise an elastic material or include one or more sections that may resiliently stretch. The waistband 60 carries the holster body 70.

In some embodiments, a location of the holster body 70 along the waistband 60 may be fixed. For example, ends of the waistband 60 may be secured (e.g., sewn, bonded, etc.) to opposite sides of the holster body 70 or, more specifically, to ends of a backing 72 of the holster body 70. Alternatively, the waistband 60 may extend through one or more features of the holster body 70 or its backing 72, which may enable the holster body 70 to slide along at least a portion of a length of the waistband 60.

The backing 72 of the holster body 70 may carry a handgun receptacle 74 capable of carrying a handgun in a desired orientation. In the depicted embodiment, the handgun receptacle 74 may be formed from a pliable fabric. Additionally, the handgun receptacle 74 may be made from an elastic fabric, which may enable the handgun receptacle 74 to securely receive and even engage a handgun placed therein.

The handgun receptacle 74 may be configured similarly to the handgun receptacle of the concealed carry holster disclosed by U.S. Design Pat. U.S. D761,553 S, issued Jul. 19, 2016 ("the '553 Design Patent"), the entire disclosure of which is hereby incorporated herein. The handgun receptacle disclosed by the '553 Design Patent includes stitching 75 that limits movement of the trigger guard of a handgun and, thus, at least partially dictates an orientation of a handgun within the handgun receptacle 74. More specifically, the stitching 75 helps orient the handgun and its grip in a manner that optimizes the wearer's ability to grasp the grip of the handgun and remove the handgun from the handgun receptacle 74 and the speed with which the wearer may grasp the grip of the handgun and remove the handgun from the handgun receptacle 74.

Optionally, the backing 72 of the holster body 70 may carry, and the holster body 70 may include, one or more pockets 78 or other features for carrying, engaging, or being engaged by one or more additional items (e.g., cartridges, one or more magazines, other hardware, a concealed carry permit, etc.). Any pockets 78 or other feature may be formed from the same types of materials that may be used to define the handgun receptacle 74.

A first strap-engaging feature 76 of the concealed carry holster 50 may be located on an outer surface of the handgun receptacle 74 of the holster body 70. The first strap-engaging feature 76 may have any suitable structure and/or features that complement (e.g., may engage, be engaged by, etc.) the first holster-engaging feature 44 (FIGS. 3-6) of the printing-reducing strap 10 (FIGS. 1-6). In the nonlimiting embodiment illustrated by FIG. 7, the first strap-engaging feature 76 comprises a loops side of a hook and loop type fastener, which may complement the hooks side embodiment of the first holster-engaging feature 44 of the printing-reducing strap 10. The first strap-engaging feature 76 may be capable of receiving the first holster-engaging feature 44 at a plurality of locations along the height of the handgun receptacle 74 (i.e., at a plurality of vertical locations), which may enable a wearer to at least partially tailor the angle at which the printing-reducing strap 10 is oriented relative to the waistband 60 and, thus, tailor the direction in which the printing-reducing strap 10 pulls a handgun (including its grip) into the wearer's body.

A second strap-engaging feature 66 of the concealed carry holster 52 may be located on a portion of the waistband 60 located adjacent to (e.g., lateral to, to the rear of, etc.) the handgun receptacle 74 of the holster body 70. The second strap-engaging feature 66 may have any suitable structure and/or features that complement (e.g., may engage, be engaged by, etc.) the second holster-engaging feature 46 (FIGS. 3-6) of the printing-reducing strap 10 (FIGS. 1-6). In the nonlimiting embodiment depicted by FIG. 7, the second strap-engaging feature 66 comprises a hooks side of a hood and loop type fastener, which may complement the loops side embodiment of the second holster-engaging feature 46 of the printing-reducing strap 10. The second strap-engaging feature 66 may becapable of receiving the second holster-engaging feature 46 at a plurality of locations along the length of the portion of the waistband 60 located closest to the handgun receptacle 74 of the holster body 70 (i.e., at a plurality of horizontal locations), which may enable a wearer to tailor tension in the printing-reducing strap 10 and, thus, tailor the force with which the printing-reducing strap 10 pulls the handgun (including its grip) into his or her body. A location at which the second holster-engaging feature 46 of the printing-reducing strap 10 is secured to the second strap-engaging feature 66 along the length of the portion of the waistband 60 located closest to the handgun receptacle 74 of the holster body 70 may also enable the wearer to at least partially tailor the angle at which the printing-reducing strap 10 is oriented relative to the waistband 60 and, thus, further tailor the direction in which the printing-reducing strap 10 pulls a handgun (including its grip), into his or her body.

Figure 8:
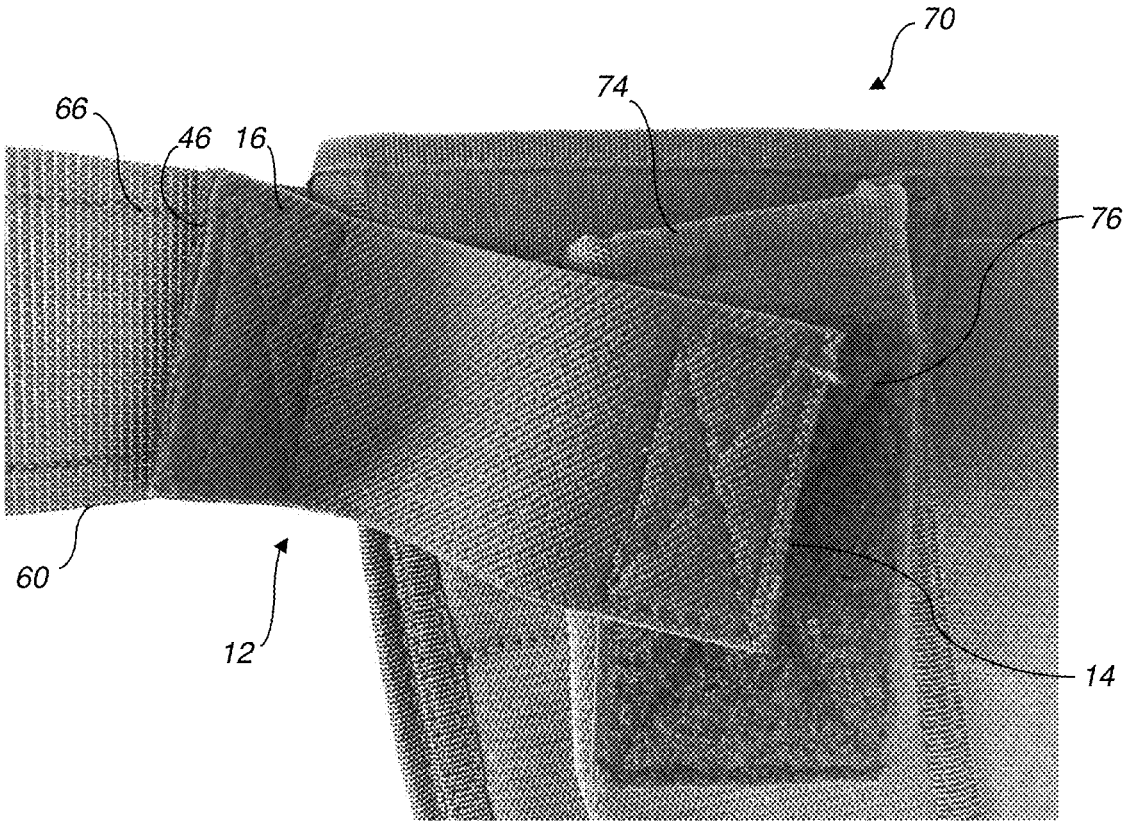
FIG. 8 illustrates a first example of an orientation of a printing-reducing strap on a concealed carry holster.
Figure 9:
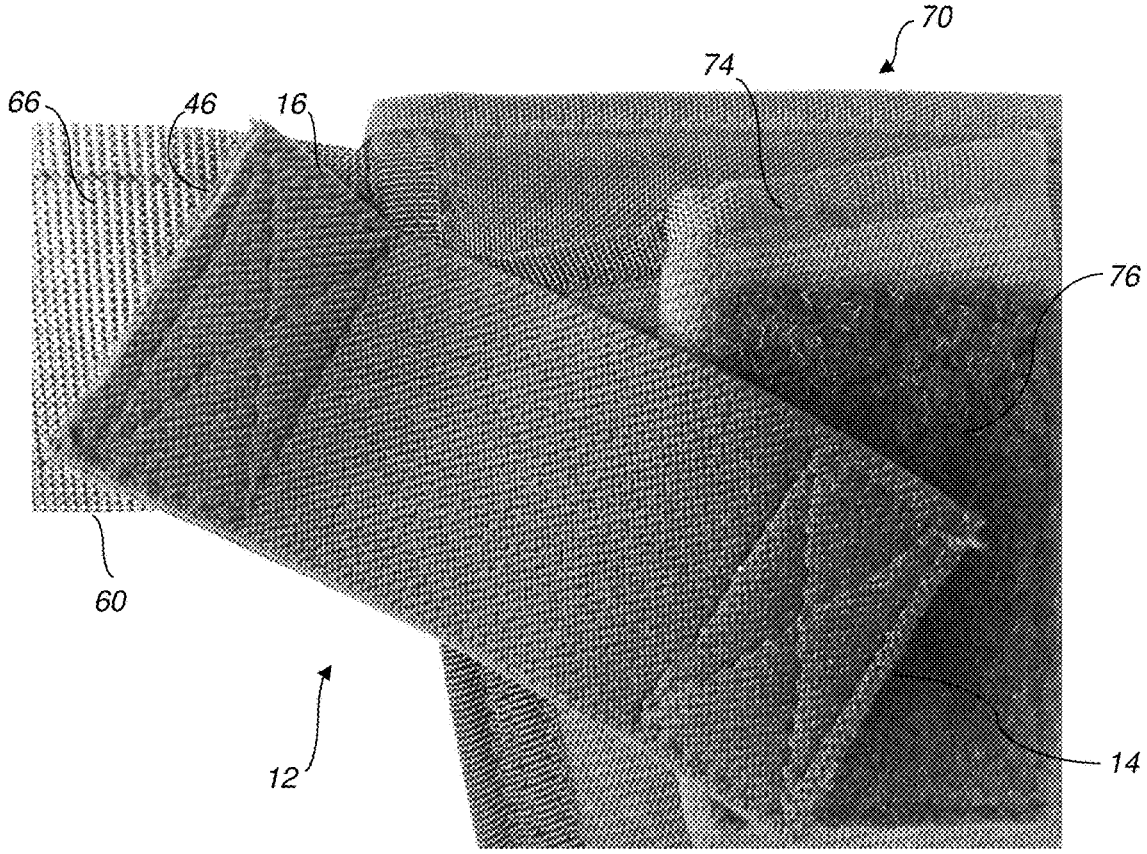
FIG. 9 depicts a second example of an orientation of a printing-reducing strap on a concealed carry holster.
Figure 10:
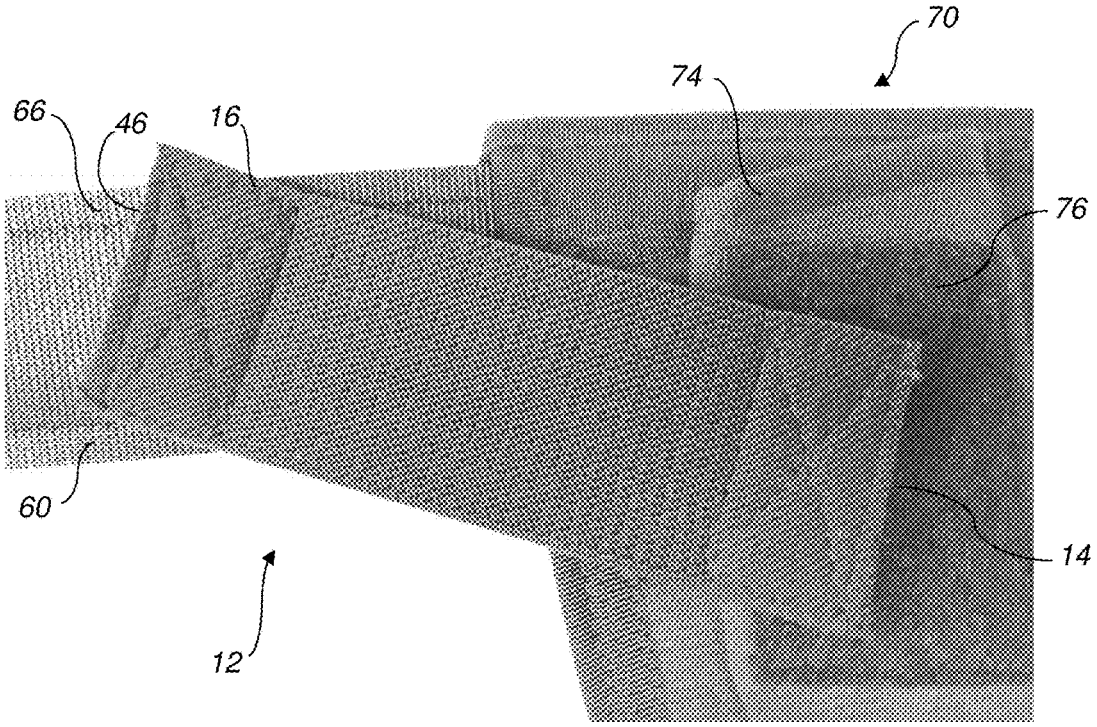
FIG. 10 shows a third example of an orientation of a printing-reducing strap on a concealed carry holster.

Referring now to FIGS. 8-10, a few examples of the manner in which a printing-reducing strap 10 may be secured between a holster body 70 and a waistband 60 of a concealed carry holster 50 are depicted. More specifically, FIGS. 8-10 depict examples in of the manner in which a first holster-engaging feature 44 (FIGS. 3-6) on the first end 14 of a printing-reducing strap 10 engages a first strap-engaging feature 76 on a handgun receptacle 74 of the holster body 70 and a second holster-engaging feature 46 on the second end 16 of the printing-reducing strap 10 engages a second strap-engaging feature 66 on the waistband 60.

In FIG. 8, the first holster-engaging feature 44 and, thus, the first end 14 of the printing-reducing strap 10 are positioned relatively high along the first strap-engaging feature 76 and the handgun receptacle 74. The second holster-engaging feature 46 secures the second end 16 of the printing-reducing strap 10 to the second strap-engaging feature 66 at a location along the waistband 60 that is relatively close to the holster body 70. This arrangement orients the printing-reducing strap 10 at a shallow angle (closer to 180° than to 135°) to the waistband 60, with relatively light tension in the printing-reducing strap 10. Thus, the printing-reducing strap 10 may pull a handgun within the handgun receptacle 74 of the holster body 70 lightly into the body of an individual wearing the concealed carry holster 50, at a location that is primarily lateral to and/or behind a grip of the handgun.

FIG. 9 depicts an arrangement in which the first holster-engaging feature 44 secures the first end 14 of the printing-reducing strap 10 near the bottom of the first strap-engaging feature 76 and a little farther than midway down the height of the handgun receptacle 74. The second holster-engaging feature 46 secures the second end 16 of the printing-reducing strap 10 to the second strap-engaging feature 66 at a location along the waistband 60 that is relatively close to the holster body 70. This arrangement orients the printing-reducing strap 10 at a steep angle (much closer to 135° than 180°) to the waistband 60, with relatively light tension in the printing-reducing strap 10. Thus, the printing-reducing strap 10 may pull a handgun within the handgun receptacle 74 of the holster body 70 lightly into the body of an individual wearing the concealed carry holster 50, at a location that is both upward and lateral to and/or behind a grip of the handgun.

In the arrangement of the printing-reducing strap 10 depicted by FIG. 10, the first holster-engaging feature 44 secures the first end 14 of the printing-reducing strap 10 midway along the height of the first strap-engaging feature 76 and about midway down the height of the handgun receptacle 74. The second holster-engaging feature 46 secures the second end 16 of the printing-reducing strap 10 to the second strap-engaging feature 66 at a location along the waistband 60 that is relatively close to the holster body 70. This arrangement orients the printing-reducing strap 10 at an intermediate angle (about midway between 135° and 180°) to the waistband 60, with relatively high tension in the printing-reducing strap 10. Thus, the printing-reducing strap 10 may pull a handgun within the handgun receptacle 74 of the holster body 70 firmly into the body of an individual wearing the concealed carry holster 50, at a location that is slightly upward and lateral to and/or behind a grip of the handgun.

Figure 11:
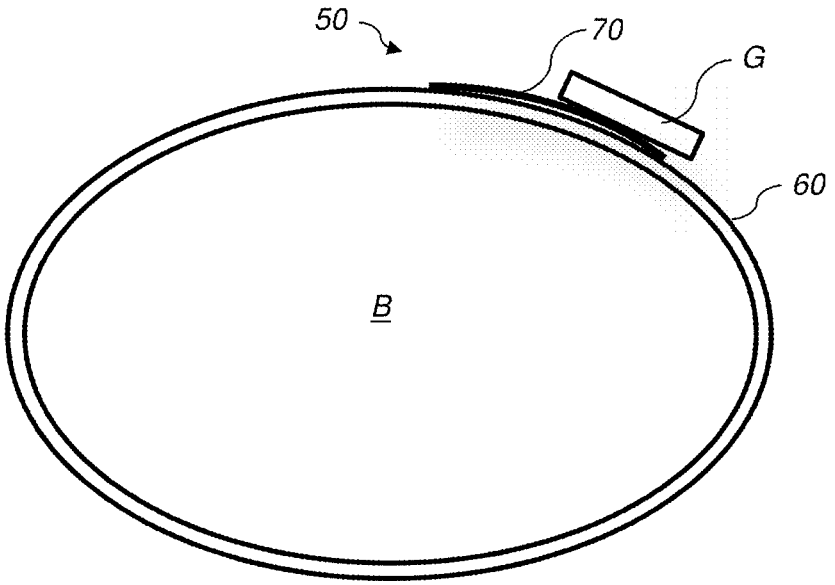
FIGS. 11 and 12 provide schematic representations of the manner in which a printing-reducing strap minimizes printing of a handgun carried by a concealed carry holster onto clothing worn by an individual.
Figure 12:
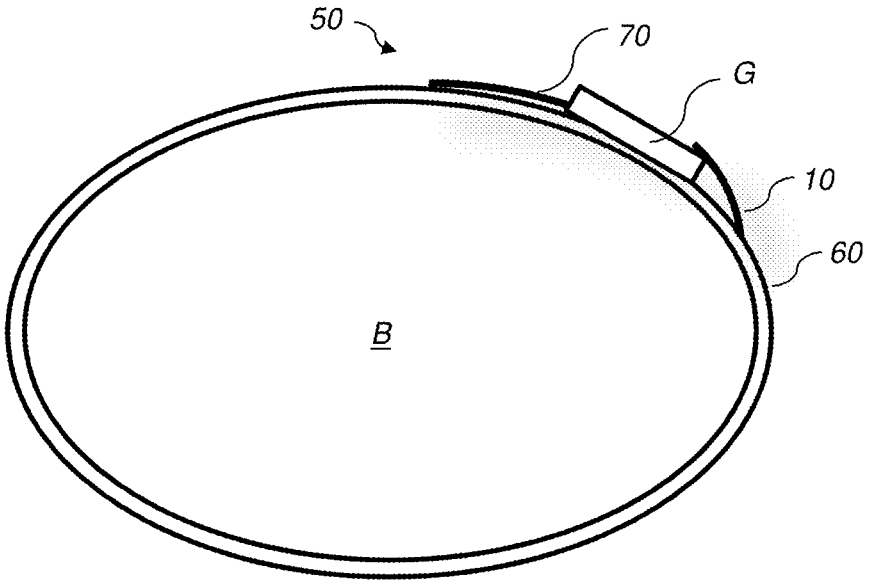

FIGS. 11 and 12 depict an embodiment of the manner in which a printing-reducing strap 10 may function with a concealed carry holster 50 to pull a handgun G into a wearer's body B to reducing printing of the handgun G, the concealed carry holster 50, and any other hardware carried by the concealed carry holster 50. FIG. 11 provides a representation of the manner in which a concealed carry holster 50, which includes a waistband 60 and a holster body 70, holds a handgun G close to the wearer's body B. Notably, despite the low profile of the holster body 70, the handgun G still protrudes somewhat, which may result in printing of the handgun G on the wearer's clothing.

FIG. 12 illustrates use of the concealed carry holster 50 with a printing-reducing strap 10 according to this disclosure. The printing-reducing strap may be secured between the holster body 70 and the waistband 60 (e.g., as shown in and described in reference to FIGS. 8-10, etc.), pulling the holster body 70 and the handgun G carried thereby into the wearer's body B, reducing any printing of the handgun G, the holster body 70, and any other items carried by the holster body 70 on the wearer's clothing. The direction in which the holster body 70, the handgun G, etc., are pulled and the extent to which they are pulled may be tailored by the wearer to both optimize comfort and provide a desired reduction in printing and, thus, maximized concealment of the handgun G beneath the wearer's clothing.

Although this disclosure provides many specifics, the specifics should not be construed as limiting the scope of any appended claim, but merely as providing information pertinent to some specific embodiments that may fall within the scopes of the appended claims. Features from different embodiments may be employed in combination. In addition, the scope of each appended claim may encompass other embodiments. All additions to, deletions from, and modifications of the disclosed subject matter that fall within the scopes of the claims are to be embraced by the claims.

What is claimed:

1. A printing-reducing concealed carry system, comprising:

a concealed carry holster, comprising:

a waistband, and a holster body; and a printing-reducing strap, comprising:

an elongated body with an outer surface, an inner surface, a first end and a second end;

a first holster-engaging feature accessible from the inner surface of the elongated body, at the first end of the elongated body, wherein the first holster-engaging feature engages a complementary first strap-engaging feature on an outer surface of the holster body of the concealed carry holster to position the first end of the elongated body over the outer surface of the holster body;

a second holster-engaging feature accessible from the inner surface of the elongated body, at the second end of the elongated body, wherein the second holster-engaging feature engages a complementary second strap-engaging feature on an outer surface of a portion of the waistband of the concealed carry holster located adjacent to a handgun receptacle of the holster body of the concealed carry holster to position the second end of the elongated body over the outer surface of the portion of the waistband, the printing-reducing strap, when the first holster-engaging feature engages the complementary first strap-engaging feature of the holster body and the second holster-engaging feature engages the complementary second strap-engaging feature of the portion of the waistband located adjacent to the handgun receptacle, pulling a handgun within the handgun receptacle of the holster body into a wearer's body to reduce printing of the handgun on clothes worn over the concealed carry holster.

2. The printing-reducing concealed carry system of claim 1, wherein the elongated body of the printing-reducing strap comprises a fabric.

3. The printing-reducing concealed carry system of claim 2, wherein the fabric of the printing-reducing strap comprises an elastic fabric.

4. The printing-reducing concealed carry system of claim 3, wherein the elastic fabric of the printing-reducing strap enables tailoring of a tension in the elongated body when the first holster-engaging feature engages the complementary first strap-engaging feature of the holster body and the second holster-engaging feature engages the complementary second strap-engaging feature of the portion of the waistband located adjacent to the handgun receptacle.

5. The printing-reducing concealed carry system of claim 1, wherein the elongated body of the printing-reducing strap comprises an outer member and an inner member in superimposed relation to one another, first ends of the outer member and the inner member secured together, second ends of the outer member and the inner member secured together, intermediate portions of the outer member and the inner member defining a receptacle.

6. The printing-reducing concealed carry system of claim 1, wherein the printing-reducing strap consists essentially of the elongated body, the first holster-engaging feature, and the second holster-engaging feature.

7. The printing-reducing concealed carry system of claim 1, wherein the printing-reducing strap consists of the elongated body, the first holster-engaging feature, and the second holster-engaging feature.

8. A concealed carry holster, comprising:

a holster body including:

a handgun receptacle having an outer surface; and a first strap-engaging feature on the outer surface of the handgun receptacle;

a waistband carrying the holster body, the waistband including:

a portion adjacent to the handgun receptacle of the holster body, the portion having an outer surface; and a second strap-engaging feature along the outer surface of the portion of the waistband adjacent to the handgun receptacle; and a printing-reducing strap, comprising:

an elongated body with an outer surface, an inner surface, a first end and a second end;

a first holster-engaging feature accessible from the inner surface of the elongated body, at the first end of the elongated body, the first holster-engaging feature capable of engaging the first strap-engaging feature of the holster body and positioning the first end of the elongated body over the outer surface of the handgun receptacle; and a second holster-engaging feature accessible from the inner surface of the elongated body, at the second end of the elongated body, the second holster-engaging feature capable of engaging the second strap-engaging feature of the portion of the waistband and positioning the second end of the elongated body over the outer surface of the portion of the waistband.

9. The concealed carry holster of claim 8, wherein the printing-reducing strap, when the first holster-engaging feature engages the first strap-engaging feature of the holster body and the second holster-engaging feature engages the second strap-engaging feature of the portion of the waistband located adjacent to the handgun receptacle, capable of pulling a handgun within the handgun receptacle of the holster body into a wearer's body to reduce printing of the handgun on clothes worn over the concealed carry holster.

10. The concealed carry holster of claim 8, wherein the elongated body comprises a fabric.

11. The concealed carry holster of claim 10, wherein the fabric comprises an elastic fabric.

12. The concealed carry holster of claim 11, wherein the elastic fabric enables tailoring of a tension in the elongated body when the first holster-engaging feature engages the first strap-engaging feature of the holster body and the second holster-engaging feature engages the second strap-engaging feature of the portion of the waistband located adjacent to the handgun receptacle.

13. The concealed carry holster of claim 8, wherein the first strap-engaging feature of the holster body is located on the handgun receptacle of the holster body.

14. The concealed carry holster of claim 13, wherein the first strap-engaging feature of the holster body is capable of receiving the first holster-engaging feature of the printing-reducing strap at a plurality of locations along a height of the handgun receptacle of the holster body.

15. The concealed carry holster of claim 14, wherein the first strap-engaging feature enables tailoring of an angle at which the printing-reducing strap is oriented relative to the waistband.

16. The concealed carry holster of claim 8, wherein the second strap-engaging feature is capable of receiving the second holster-engaging feature of the printing-reducing strap at a plurality of locations along a length of the portion of the waistband adjacent to the handgun receptacle of the waistband.

17. The concealed carry holster of claim 16, wherein the second strap-engaging feature enables tailoring of a tension within the printing-reducing strap upon assembly of the printing-reducing strap with the holster body and the waistband.

18. A method for reducing printing of a handgun carried by a concealed carry holster, comprising:

securing a waistband of the concealed carry holster around a waist of an individual;

placing a handgun in a handgun receptacle of a holster body of the concealed carry holster;

securing a first end of a printing-reducing strap to the holster body with the first end of the printing-reducing strap located over an outer surface of the handgun receptacle of the holster body; and securing a second end of the printing-reducing strap to a portion of the waistband located adjacent to the handgun receptacle of the holster body with the second end of the printing-reducing strap located over an outer surface of the portion of the waistband to introduce tension into the printing-reducing strap and to pull the handgun into a body of the individual.

19. The method of claim 18, wherein securing the first end of the printing-reducing strap to the holster body comprises securing the first end of the printing-reducing strap to the holster body at a location along a height of the holster body that will pull the handgun in a desired direction into the body of the individual.

20. The method of claim 18, wherein securing the second end of the printing-reducing strap to the portion of the waistband located adjacent to the handgun receptacle of the holster body comprises securing the second end of the printing-reducing strap to the portion of the waistband at a location along the portion of the waistband that will pull the handgun into the body of the individual with a desired amount of force.

* * * * *